US009202361B2

(12) United States Patent
Rubio Andres et al.

(10) Patent No.: US 9,202,361 B2
(45) Date of Patent: Dec. 1, 2015

(54) FALL DETECTION

(71) Applicant: Vodafone IP Licensing Limited, Newbury, Berkshire (GB)

(72) Inventors: Francisco Javier Rubio Andres, Madrid (ES); Patricia Alonso Diaz, Madrid (ES); Daniel Almodovar Herraiz, Madrid (ES); Guillermo Bruno Esteve Asensio, Madrid (ES)

(73) Assignee: VODAFONE IP LICENSING LIMITED, Newbury, Berkshire (GB)

( * ) Notice: Subject to any disclaimer, the term of this patent is extended or adjusted under 35 U.S.C. 154(b) by 169 days.

(21) Appl. No.: 14/013,735

(22) Filed: Aug. 29, 2013

(65) Prior Publication Data

US 2014/0062702 A1 Mar. 6, 2014

(30) Foreign Application Priority Data

Aug. 29, 2012 (ES) ..... 201231342

(51) Int. Cl.

| | |
|---|---|
| ***G08B 23/00*** | (2006.01) |
| ***G08B 21/04*** | (2006.01) |
| ***G08B 29/18*** | (2006.01) |

(52) U.S. Cl.

CPC ..... *G08B 21/043* (2013.01); *G08B 21/0446* (2013.01); *G08B 29/188* (2013.01)

(58) Field of Classification Search

None

See application file for complete search history.

(56) References Cited

U.S. PATENT DOCUMENTS

| | | | | |
|---|---|---|---|---|
| 2006/0071798 | A1 * | 4/2006 | Kiff et al. | 340/573.1 |
| 2009/0128320 | A1 * | 5/2009 | Needham et al. | 340/504 |
| 2014/0091934 | A1 * | 4/2014 | Vallance et al. | 340/573.1 |
| 2014/0313036 | A1 * | 10/2014 | Sweeney et al. | 340/573.1 |

* cited by examiner

*Primary Examiner* — Travis Hunnings

(74) *Attorney, Agent, or Firm* — Workman Nydegger

(57) ABSTRACT

According to an aspect of the present disclosure, there is provided a method in a portable electronic device for handling fall detection, the method comprising: detecting a suspected fall; and, preventing or suspending, at least temporarily, a triggering of a fall process based on a status and/or historical status of the electronic device, the status and/or historical status being at the time the suspected fall was detected. A portable electronic device and computer readable medium may also be provided.

14 Claims, 4 Drawing Sheets

FALL DETECTION

CROSS REFERENCE TO RELATED APPLICATIONS

This application claims priority to Spanish Application Number 201231342, filed on Aug. 29, 2012, the entirety of which is incorporated herein by reference.

BACKGROUND TO THE INVENTION

Fall detection using electronic devices is already known in the art. These are particularly widespread in the geriatric field, where it is often the case that a subject may fall and subsequently be unable to call for help. For example, U.S. Pat. No. 7,450,332 discloses an integrated free-fall detection device for a portable apparatus where an acceleration sensor generates acceleration signals correlated to the components of the acceleration of the portable apparatus along three detection axes, said device encompassing a dedicated purely hardware circuit connected to the acceleration sensor, which generates a free-fall detection signal in a continuous manner and in real-time. The free-fall detection signal has a first logic value in the event that the acceleration signals are simultaneously lower than a respective acceleration threshold, and this value is sent to a processor unit of the portable apparatus as an interrupt signal to activate the appropriate actions of protection for the portable apparatus.

In another example, European patent EP1870037 discloses a portable apparatus for detecting falls and immobility of a subject, comprising at least one sensor that generates a signal indicative of the accelerations of at least one portion of the subject's body, a control unit suitable for processing this signal and communication means for sending a call for help to a remote control station. The control unit may automatically activate the communication means only when a fall of the subject and his/her subsequent immobility are detected based on said processing. Typically in fall detection apparatus, as exemplified by EP1870037, a guard time timer is provided that ensures that the apparatus is immobile after a sudden change in movement. In this way, false positives that are created purely as a result of sharp or exaggerated movement are reduced.

Present fall detectors implementations are typically based on specific devices such as those described above to be fixed to the wrist or the hip, which include an accelerometer and run certain mathematical algorithms in order to determine whether a fall event has occurred.

Such portable electronic devices which are designed to be worn near the hip on a belt or a clip on the belt are considered to be the most reliable ones because the hip is generally less prone to sporadic movement than a subject's limbs. Nevertheless, they generally have to rely on an indication that the device is locked onto the hip and otherwise not to activate the fall detection algorithm. Others such portable electronic devices that are designed to be worn on the wrist, for example, on watches, generally provide a lower detection success rate and is accountable for more false positive results than devices designed to be worn near the hip because the device is not so close to the body's center of gravity and the movement is generally less stable.

A problem with the current techniques for detecting a fall event is that the percentage of successful fall detections is not adequately high and the percentage of false positive detections is not adequately low. A false positive detection may be understood as a positive detection event that has been triggered incorrectly, i.e. a positive output is given although a fall event has not actually occurred. It is therefore an object of the present invention to provide a method, system and device for detecting fall event with improved accuracy, offering high rate of successful fall detections and a low rate of false positive detections.

SUMMARY OF THE INVENTION

According to an aspect of the present disclosure, there is provided a method in a portable electronic device for handling fall detection, the method comprising: detecting a suspected fall; and, preventing or suspending, at least temporarily, a triggering of a fall process based on a status and/or historical status of the electronic device, the status and/or historical status being at the time the suspected fall was detected. In this way, false positives are reduced as the device may prevent or suspend the process that occurs once a fall has been detected. If it is unlikely that a fall occurred, but rather a drop or similar, then the fall that has been detected can be ignored. The present disclosure is operable to utilise conventional fall detection algorithms.

The status and/or historical status of the electronic device may comprise: an input event being detected during a predetermined time period prior to the suspected fall being detected. The input event may be actuation of a button on the electronic device. Alternatively, the input event may be detection of a touch on a touch screen of the electronic device. In this way, if the device was being used prior to the fall, then a drop is more likely to have occurred rather than a fall have occurred when the user is walking along, i.e. not using the device.

The status and/or historical status of the electronic device may comprise: a voice call being ongoing. The triggering of the fall process may be suspended until termination of the voice call. The triggering of the fall process may be prevented if the voice call is maintained for a predetermined amount of time after the detection of the suspected fall. If a call is ongoing, an alert should not be sent generating a false positive. After call hangup, the user may be presented with an alert to confirm if an alert should not be sent.

The status and/or historical status of the electronic device may comprise: a screen lock process occurring during a predetermined time period prior to the suspected fall being detected.

The method may further comprising: detecting movement of the electronic device; determining, based on the detected movement, whether or not a user of the electronic was walking at the time or prior to, during a predetermined time period, the suspected fall being detected; and, preventing the triggering of the fall process where the user was not walking. Thus the fall alert is prevented when a fall is unlikely to have occurred and has been generated accidentally such as a drop of the device or similar. Only when the user is walking is a fall likely to have occurred and therefore only in those circumstances should an alert be generated. As above, the present disclosure dramatically reduces the chances of false positives being generated.

The fall process may comprise: initialising a guard time timer for confirming that a fall has occurred; upon expiry of the guard time timer, informing the user that a fall has been detected and initialising a cancellation time timer; and, before expiry of the cancellation time timer, providing the user with an opportunity to prevent an alert from being sent to a security system.

A portable electronic device and computer readable medium may also be provided.

BRIEF DESCRIPTION OF THE DRAWINGS

Preferred embodiments of the present invention will now be described with reference to the accompanying drawings, in which.

DETAILED DESCRIPTION

Figure 1:
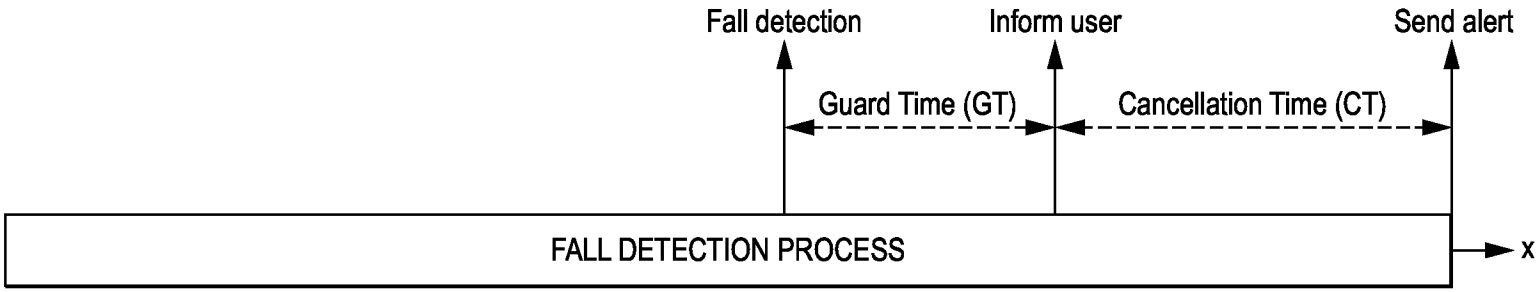
FIG. 1 shows a mobile fall detection method.

Referring to FIG. 1, an example overview of a known mobile fall detection method is shown. Time is shown along the x-axis.

The device may be fixed to the wrist, held at the hip, held in the hand, or otherwise held any other conceivable position of the subject's body. The device comprises means for detecting a fall event, for example, using at least one accelerometer. The device may be a specific device that is dedicated to detecting fall events, or it may be a non-specific device, for example, a mobile phone or a tablet device, that has the capability of detecting fall events. Preferably, the device provides sufficient sensitivity and an adequate refresh rate in order to detect fall events.

In the example a positive fall detection result is triggered, for example, based on one or several abrupt change(s) in acceleration. A guard time (GT) timer is initiated during which the device detects whether there is any further movement of the subject. Alternatively, the GT timer may be initiated when the device detects that the subject is lying on the ground, for example, by detecting the relation position (x,y,z) of the subject to the ground. At the end of the GT, the subject may be informed that a positive fall detection result is currently set.

Considering that sudden changes in acceleration and/or detection that a subject being close to the ground may not necessarily indicate that a fall event has actually occurred, a cancellation time (CT) timer may also be initiated, which gives the subject a certain amount of time to cancel a positive fall detection result. The CT timer may start subsequent to the end of the GT timer (as shown in FIG. 1), or it may be initiated at the same time as the GT timer (not shown) and comprise a longer time period than the GT. During the CT, the subject may voluntarily and manually cancel the positive fall detection result (before or after the device informs the subject of such a result), for example if he believes that no fall event has occurred or if he does not wish for the device to send a signal for help.

At the end of the CT, the device may automatically send a signal for help if the subject has not cancelled this function, for example, for the reasons described above. In order to send a signal or alert to, for example, a remote device, the device may be communicatively coupled to said remote device.

Figure 2:
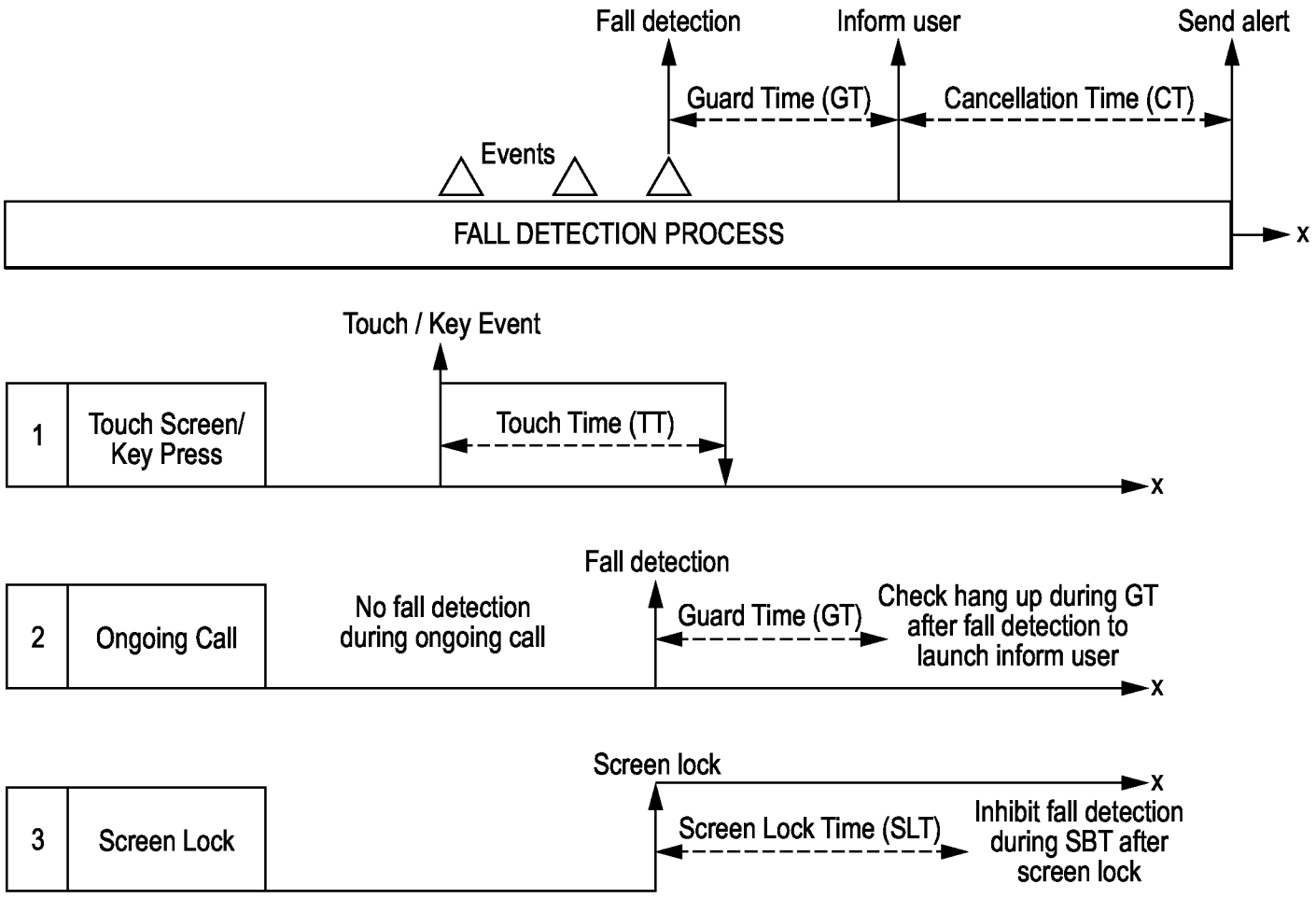
FIG. 2 shows an example implementation of the algorithm of the present invention.

Referring now to FIG. 2, example implementations of the algorithm of the present invention are shown. These may be implemented alone or, preferably, in addition, for example, in parallel or sequentially, to the method as shown in FIG. 1. Time is shown along the x-axis.

The device on which the method of the present invention is performed (for example, the methods shown in FIG. 2) may be a specific device or a non-specific device. Implementations based on specific devices are dedicated only to fall detection and this could mean that the subject may forget to wear the device; the subject may not be expecting to fall constantly. Non-specific devices, for example, a mobile phone or tablet, may be more likely to be carried by the subject on a routine basis. Previous attempts to move towards non-specific devices with the capability of detecting fall events have generally failed because some usual movements done to use the non-specific device may result in a false positive fall detection result. However, the present invention offers algorithms, examples of which will be described below, that provide additional accuracy and reliability required to overcome this problem.

FIG. 2 shows a first example of an algorithm of the present invention. Say, for example, that the device is a mobile device that utilises a touch screen as a user interface. The algorithm of FIG. 2 checks whether the touch screen or a key on the touch screen has been pressed. Once such a touch screen press event has been detected, a touch time (TT) timer may be initiated, during which a fall detection event will not be triggered, i.e. the fall detected event is over-ridden.

FIG. 2 shows a second example of an algorithm of the present invention. Say, for example, that the device is a mobile phone. The algorithm of FIG. 2 checks for ongoing calls of the mobile phone. During ongoing calls, if the fall detection event is activated and a positive output results, the algorithm of FIG. 2 will check at the end of the GT that the call is maintained. If yes, the positive fall detection result will be cancelled; if no, the user may be informed that a positive fall detection result is currently set and the subject may be given a CT in order to cancel the positive fall detection results in the same manner as described above for FIG. 1. If, say at the end of the CT, the subject has not cancelled the positive fall detection result, then a signal or alert may be sent to a remote device in the same manner as described above for FIG. 1.

FIG. 2 shows a third example of an algorithm of the present invention. Say, for example, that the device is a mobile phone that may be locked. The algorithm of FIG. 2 checks for the event that the mobile phone is locked. If yes, a screen lock time (SLT) timer is initiated, and the fall detection means is over-ridden. The SLT timer ends when it is detected that the mobile phone has been unlocked. If no, fall detected occurs in the same manner as shown in FIG. 1.

It will be appreciated that each of the methods of FIG. 2 may be performed separately, in combination with each other, or in combination with any other algorithm of the present invention.

Figure 3:
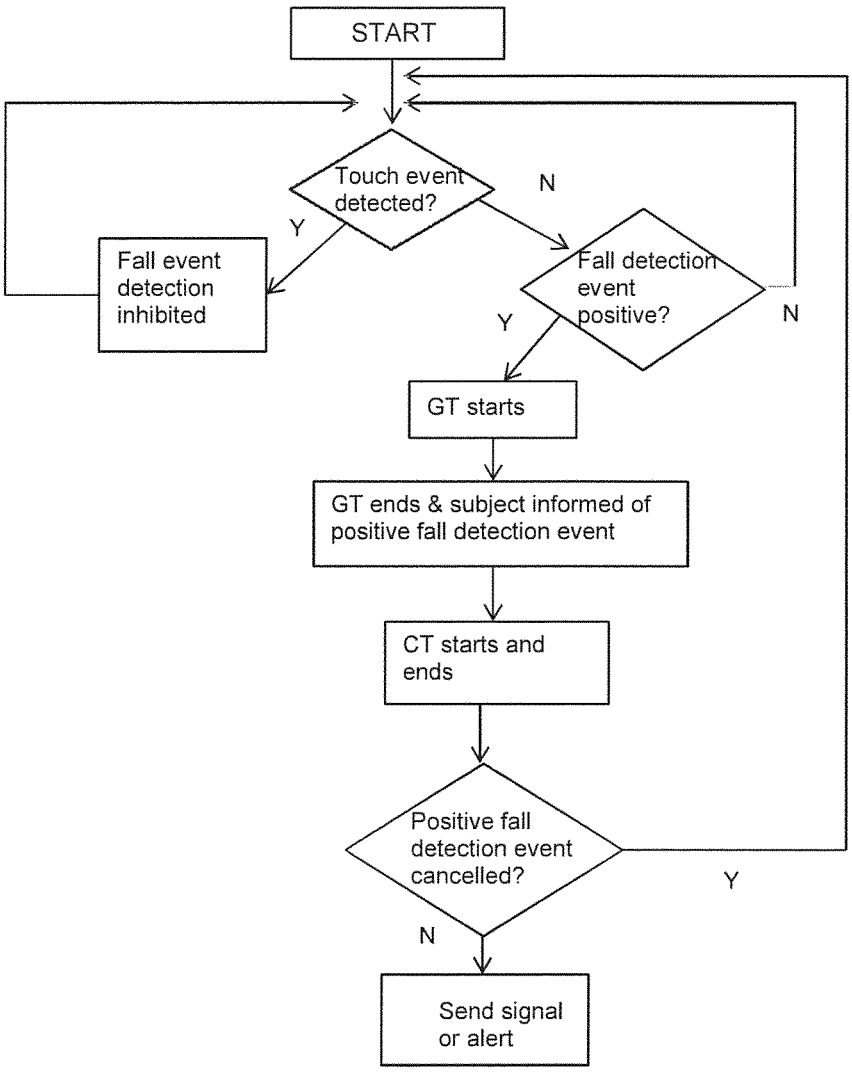
FIG. 3 shows an exemplary flow chart of the of the present invention.

FIG. 3 shows an example flow chart of the on-top algorithm of the present invention, corresponding to FIG. 2.

A device and a method will now be described for detecting a fall of the user bearing the device. The fall detection is accomplished by determining a certain number of events and different responses to said events.

An object of the invention proposes a solution to fall detection devices offering a low rate of false positives. An object of the invention solves said problem by providing a portable electronic device and a method of managing said device allowing the electronic device to activate the fall detection event reducing the false positive percentage and at the same time allowing the use of a device that you are used to charging and wearing every day like a mobile phone.

The quality of a fall detector method comes from the percentage of successful fall detections and the percentage of false positives. The first one should be high: around 90% is a good value for the different fall types. The second should be minimum: values of 5% are acceptable for the daily activities.

The current state of the art shows that nobody has provided these values using mobile phones acting as the electronic device used to determine a fall event, since users perform movements with the mobile phone that lead to reduce the fall detection success or increase the percentage of false positives.

This document proposes both a device and a method, which may actually work on top of any given fall detection procedure furnished at any similar device, based in specific mobile phone assets to allow the use of a mobile phone as a fall detector device with the same reliability than specific devices as those mentioned in the art worn on the hip.

One of the most important requirements is that of the electronic device comprising acceleration detection means, namely accelerometer. Accelerometers of mobile phones are considered sensitive enough, and have a suitable refresh rate, to be used by any standard fall detector procedure. Since the fall detector method and device hereby described are mainly based in abrupt changes in the acceleration and a guard time (GT) where no movement is detected in the body, they may be also base the alarm in the relative position (x,y,z) of the device related to the floor to detect a person lying down.

Bearing in mind that falls or sudden changes in acceleration or relative position may happen, the object of the invention, both the device itself and the method, may account an additional amount of time given to user to voluntarily and manually cancel the fall detection alert cancellation time (CT).

In order to avoid false positives the solution hereby posed takes into account the amount of acceleration changes detected, the calibration provided and the sensitivity grader tuned by the parameters,), reducing the possibility of false positives. As earlier stated the method of the invention may work on top of any other fall detection method or in combination with the latter.

Preferably, other processes based on the accelerometer itself, may be checked or monitored, for example checking that the person is walking to activate the fall detection event with security. Finally the use of the accelerometer as acceleration detection means and any others contexts or parameters potentially monitored by the hardware of the device might be used to provide an automatic variation of the fall detector parameters or even the modification of the fall detector method depending on the user context.

Apart from the accelerometer, there are others mobile assets that might be used as context indicator related to different triggers or timers, for example:

- GPS that could be used for indoor or outdoor detection, and attaching geo-referenced information to the fall alarm once the event is triggered.
- Launch a text-to-speech message to ask about the user health status and record the response in order to process it and detect specifics words or silence, thus triggering the event i.e. the accelerometer detects a sudden change in acceleration a TTS is launched, no answer is received a timer is set a TTS Timer, after the time allocated to said time and no response identified or checked as positive, the fall alarm is then triggered.
- Power charging. To avoid more false positives, the processing unit might check and monitor the battery level of the device.
- Camera. The processing unit might command a built-in camera activate and with a single algorithm decide what to do if the captured image is, for example, a dark or the sky or a face. The same principal could also apply to a video, for security and to provide more information the camera can start to record video and audio while the text-to-speech is trying to capture information around.

Any combination of the above.

A preferred embodiment of the invention is depicted by the Figures where the fall detection method of the invention is running, in said picture the skilled person may account for several processes, some are running in parallel whilst others are running sequentially even in a conditional way.

In this preferred embodiment a fall detection event occurs when a fall is detected by an accelerometer, said event is acknowledged (thus an alarm signal is sent) or discarded depending on the results of checking several processes or subprocesses being carried on by a portable fall detection electronic device, in this case a mobile phone equipped with:

- wireless communication means operative to create at least a connection to a radio communication network for establishing at least a voice call,
- at least one acceleration detection module,
- at least one timer operative to manage timebased events on the device by means of a processing unit,
- and input/output means operative to allow the input or output of data for this preferred embodiment a touch screen and at least one key/button are selected.

The processing unit of the device is connected to the at least one timer and can actuate to suspend, at least temporarily, a fall detection trigger, thus a sending of alert, for a certain period of time after at least one specific context (touch time, guard time, screen lock time, cancellation and time cancellation request, or a status and/or historical status of the device itself) is determined by the at least one timer (touch time timer, guard time timer, screen lock time timer, cancellation time timer). Hence the processing unit starts a process to check and monitor whether the touch screen is being actuated or any key pressed in the mobile, once that the screen is touched and during the timer called touch time (TT) the fall detection activation event is discarded. If no input is detected on the screen acting input/output means then the processing unit performs a process to monitor and check ongoing calls on the mobile phone. During ongoing calls if the fall detector event is activated, the process will check during the timer called guard time (GT) a period of time that the ongoing call is maintained and, after that, it will discard or not the fall detector event depending on the screen lock time timer (SLT); after the screen lock process is launched the screen lock time timer and until expire all the fall detection events will be discarded.

Figure 4:
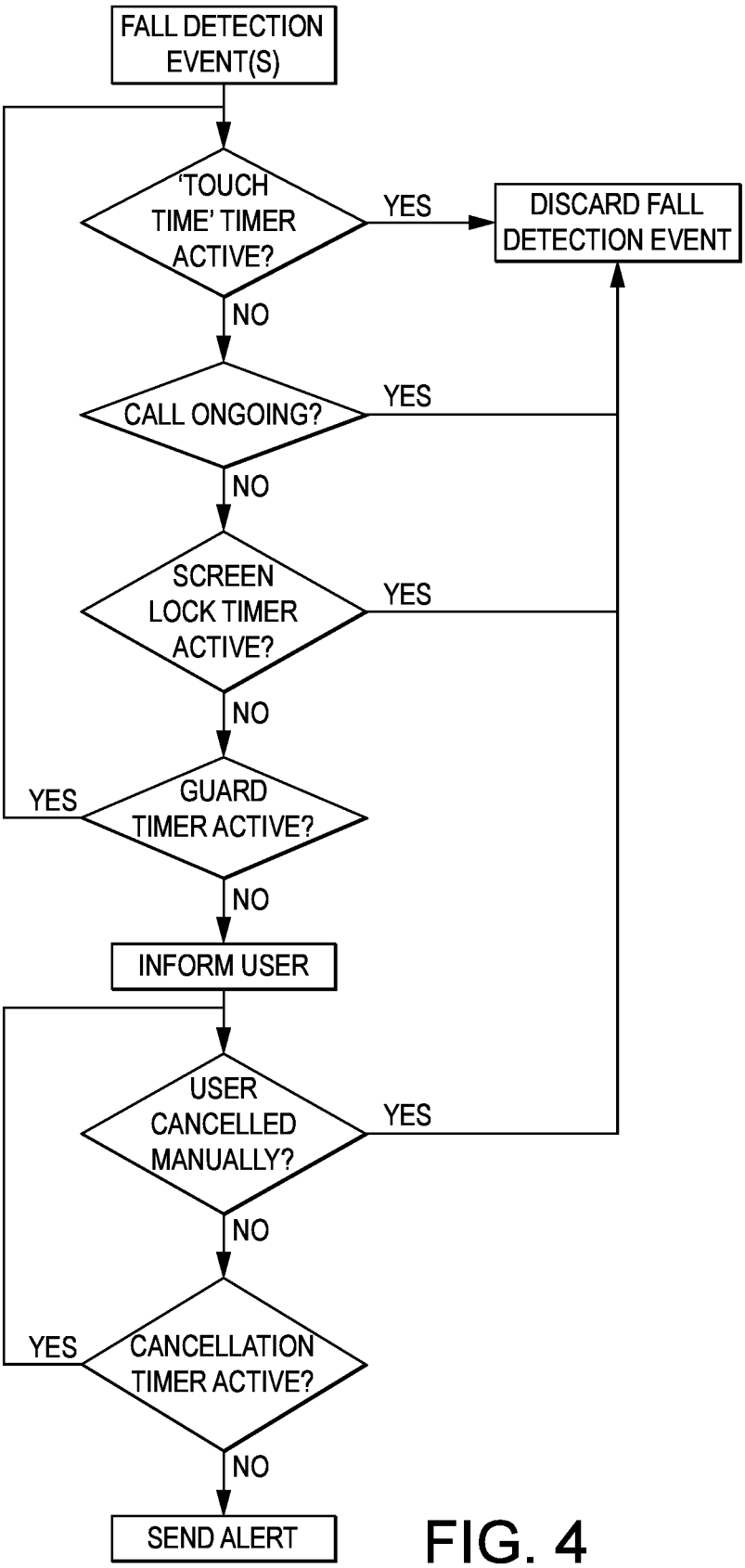
FIG. 4 shows another example flow chart of an embodiment of the method of the present invention.

Referring now to FIG. 4, another example of a flow chart of an embodiment of the method of the present invention is shown.

In this flow chart the fall detection method is ready for sending an alert using a portable electronic devices with wireless communication capabilities, the method as seen in said FIG. 4 the method does not send any alert before suspending at least temporarily a fall detection trigger, thus the sending of the alert depends [at least for a certain period of time] on after at least one specific context to be determined; and the result of said context allows the determination of another context or the assumption that no fall event is detected.

Since the method establishes priorities to the context and events, the response to a certain context condition the determination of the next, that is to say contexts are dependent and sometimes the response to one of the excludes the next to be determined.

Referring to FIG. 4, the skilled person may notice that the first specific context to be determined is related to a touch time timer associated to input means of the electronic device; the determination of said context set the fall detection event as discarded when the touch time timer is determined to be activated whereas if it is determined to be deactivated a second context is monitored. When the touch time timer is determined to be deactivated, the processing unit of the electronic device (mobile phone) determines whether an ongoing call is established on said electronic device or not, if an on going call is determined to be established on the mobile phone then the fall detection event is discarded, if not the processing unit follows the method depicted by FIG. 4 and starts determining whether a screen lock time timer is activated or not. If the screen lock time timer is determined to be deactivated then the fall detection method starts over again from the beginning, determining the touch time timer, if not the processing unit proceed with informing the user of the triggering of the fall detection event by means of the input/output means . . . a beep, a message on the screen, a blink of a led, or any visible or audible message.

Once the user is properly informed he or she may trigger a cancellation request in response to the information received, i.e. it's been a false positive since the user was just playing on the ground, then the fall detection event if discarded. If the user does not perform the cancellation then the processing unit invokes the next context to check whether a cancellation time timer is activated or not; if the cancellation time timer is determined to be activated the processing unit will trigger the cancellation request again, if not an alert will be sent.

In other example of the present invention (not shown in the Figures), other processes based on the accelerometer itself, may be checked or monitored, for example, checking that the subject is walking before activating the fall detection event. For example, a fall event detection that follows from a subject who is determined to be walking at the time may be more likely to be a real fall event as opposed to a situation where the subject is determined to be still at the time that the fall event is detected.

The following are particularly preferred aspects according to the present disclosure.

Numbered clause 1. Portable fall detection electronic device comprising:

wireless communication means operative to create at least a connection to a radio communication network for establishing at least a voice call, at least one acceleration detection module for detecting changes in the acceleration of the device and trigger a fall detection event, at least one timer operative to manage timebased events on the device bye means of a processing unit, and input/output means operative to allow the input or output of data, characterized by the processing unit being connected to the at least one timer and being said processing unit operative to suspend at least temporarily a fall detection event, thus a sending of an alert, for a certain period of time after at least one specific context is determined by the at least one timer.

Numbered clause 2. Portable fall detection electronic device according to numbered clause 1 wherein the input means and the output means are defined by a touch screen.

Numbered clause 3. Portable fall detection device wherein the timer is selected from the group consisting of: touch time timer, guard time timer, screen lock time timer, cancellation time timer.

Numbered clause 4. Fall detection method for sending an alert once a fall event has been eventually detected by an accelerometer of a portable electronic device with wireless communication capabilities, the method characterized by comprising suspending at least temporarily a fall detection trigger, thus the sending of the alert, for a certain period of time after at least one specific context is determined.

Numbered clause 5. Fall detection method according to numbered clause 4 the specific context to be determined is related to a touch time timer associated to input means of the electronic device.

Numbered clause 6. Fall detection method according to numbered clause 5 wherein the fall detection event is discarded when the touch time timer is determined to be activated.

Numbered clause 7. Fall detection method according to numbered clause 5 wherein the touch time timer is determined to be deactivated, further comprising determining whether an ongoing call is established on the electronic device or not.

Numbered clause 8. Fall detection method according to numbered clause 7 wherein the fall detection event is discarded when the ongoing call is determined to be established.

Numbered clause 9. Fall detection method according to numbered clause 8 wherein the ongoing call is determined to be non-established, further comprising determining whether a screen lock time timer is activated or not.

Numbered clause 10. Fall detection method according to numbered clause 9 wherein the screen lock time timer is determined to be deactivated further comprising restarting the fall detection method Numbered clause 11. Fall detection method according to numbered clause 9 wherein guard time timer is determined to be de-activated, further comprising informing the user of the triggering of the fall detection event.

Numbered clause 12. Fall detection method according to numbered clause 11 further comprising a user cancellation request in response to the information received.

Numbered clause 13. Fall detecting method according to numbered clause 12 comprising discarding the fall detection event when the user cancellation request is accepted.

Numbered clause 14. Fall detection method according to numbered clause 13 wherein the user cancellation request is refused, further comprising whether a cancellation time timer is activated or not.

Numbered clause 15. Fall detection method according to numbered clause 14 wherein the cancellation time timer is determined to be activated, further comprising restarting the method from the user cancellation request.

Numbered clause 16. Fall detection method according to numbered clause 15 wherein the wherein the cancellation time timer is determined to be deactivated, further comprising sending the alert.

Numbered clause 17. Fall detection method according to any one of numbered clauses 4 to 15 wherein the at least one specific context comprises a status and/or historical status of the device itself.

The invention claimed is:

1. A method in a portable electronic device for handling fall detection, the method comprising:

detecting a suspected fall; and, preventing or suspending, at least temporarily, a triggering of a fall process based on a status and/or historical status of the electronic device, the status and/or historical status being at the time the suspected fall was detected, the status and/or historical status of the electronic device corresponding to activities that are indicative that the electronic device is being used when the fall is detected such that that any movement of the electronic device is a fall of the device and not a fall of the user of the device.

2. A method according to claim 1, wherein the status and/or historical status of the electronic device comprises:

an input event being detected during a predetermined time period prior to the suspected fall being detected.

3. A method according to claim 2, wherein the input event is actuation of a button on the electronic device.

4. A method according to claim 2, wherein the input event is detection of a touch on a touch screen of the electronic device.

5. A method according to claim 1, wherein the status and/or historical status of the electronic device comprises:

a voice call being ongoing.

6. A method according to claim 5, wherein the triggering of the fall process is suspended until termination of the voice call.

7. A method according to claim 6, wherein the triggering of the fall process is prevented if the voice call is maintained for a predetermined amount of time after the detection of the suspected fall.

8. A method according to claim 1, wherein the status and/or historical status of the electronic device comprises:

a screen lock process occurring during a predetermined time period prior to the suspected fall being detected.

9. A method according to claim 1, further comprising:

detecting movement of the electronic device;

determining, based on the detected movement, whether or not a user of the electronic device was walking at the time of, prior to, or during a predetermined time period, the suspected fall being detected; and, preventing the triggering of the fall process where the user was not walking.

10. A method according to claim 1, wherein the fall process comprises:

initialising a guard time timer for confirming that a fall has occurred;

upon expiry of the guard time timer, informing the user that a fall has been detected and initialising a cancellation time timer; and, before expiry of the cancellation time timer, providing the user with an opportunity to prevent an alert from being sent to a security system.

11. A computer readable medium containing instructions which when executed by a processor of a portable electronic device cause the portable electronic device to carry out the method of claim 1.

12. A portable fall detection electronic device comprising:

wireless communication means operative to create at least a connection to a radio communication network for establishing at least a voice call, at least one acceleration detection module for detecting changes in the acceleration of the device and trigger a fall detection event, at least one timer operative to manage timebased events on the device bye means of a processing unit, and input/output means operative to allow the input or output of data, wherein a processing unit is connected to the at least one timer and said processing unit operative to suspend at least temporarily a fall detection event, thus a sending of an alert, for a certain period of time after at least one specific context is determined by the at least one timer, the context corresponding to activities that are indicative that the electronic device is being used when the fall is detected such that that any movement of the electronic device is a fall of the device and not a fall of the user of the device.

13. A portable fall detection electronic device according to claim 12, wherein the input means and the output means are defined by a touch screen.

14. A portable fall detection device according to claim 12, wherein the timer is selected from the group consisting of: touch time timer, guard time timer, screen lock time timer, cancellation time timer.

* * * * *